US009016889B2

(12) United States Patent
Cheng-Wei et al.

(10) Patent No.: US 9,016,889 B2
(45) Date of Patent: Apr. 28, 2015

(54) ELECTRIC SHOCK PROOF LAMP

(75) Inventors: Chen Cheng-Wei, New Taipei (TW); Tsai Cheng-Jung, New Taipei (TW); Fu Hao-Jan, New Taipei (TW); Liu Chin-Tsai, New Taipei (TW); Chien Wen-Hsiang, New Taipei (TW)

(73) Assignee: Justenergy Technology Corp., New Taipei (TW)

( * ) Notice: Subject to any disclaimer, the term of this patent is extended or adjusted under 35 U.S.C. 154(b) by 75 days.

(21) Appl. No.: 13/339,116

(22) Filed: Dec. 28, 2011

(65) Prior Publication Data

US 2013/0088862 A1 Apr. 11, 2013

(30) Foreign Application Priority Data

Oct. 7, 2011 (TW) ..... 100136417 A

(51) Int. Cl.

| | |
|---|---|
| ***F21V 21/00*** | (2006.01) |
| ***F21V 25/04*** | (2006.01) |
| ***H01R 33/08*** | (2006.01) |
| ***F21K 99/00*** | (2010.01) |
| *F21Y 101/02* | (2006.01) |

(52) U.S. Cl.

CPC ..... *F21V 25/04* (2013.01); *H01R 33/089* (2013.01); *F21K 9/17* (2013.01); *F21Y 2101/02* (2013.01); *F21K 9/175* (2013.01)

(58) Field of Classification Search

USPC ..... 362/217.13, 217.02, 217.12, 217.01, 362/221, 249.02

See application file for complete search history.

(56) References Cited

U.S. PATENT DOCUMENTS

2011/0235319 A1* 9/2011 Fukano et al. ..... 362/217.14
2012/0300445 A1* 11/2012 Chu et al. ..... 362/217.13

FOREIGN PATENT DOCUMENTS

| | | | |
|---|---|---|---|
| CN | 102155721 | A | 8/2011 |
| JP | 2000173329 | A | 6/2000 |
| JP | 3167851 | B2 | 5/2001 |

OTHER PUBLICATIONS

Chinese Office Action corresponding to Application No. 201110312955.7, issued on Apr. 3, 2013.
Office Action for Corresponding Taiwanese Office Action No. 100136417 dated Aug. 19, 2013.
Office Action for Corresponding Chinese Office Action No. 201110312955.7 dated Nov. 5, 2013.

* cited by examiner

*Primary Examiner* — Anh Mai
*Assistant Examiner* — Jessica M Apenteng
(74) *Attorney, Agent, or Firm* — Ditthavong & Steiner, P.C.

(57) ABSTRACT

A light lamp includes a light tube, a first holder and a first rotator. The first holder is mounted on a side of the light tube, and comprises a mounting space therein and two through holes in communication with the mounting space. The first rotator is movably received in the mounting space of the first holder between a first position and a second position, and comprises two electrodes extending from the through holes such that when the first rotator is in the first position, the electrodes are electrically connected to the light tube and when the first rotator is in the second position, the electrodes are electrically disconnected to the light tube.

18 Claims, 5 Drawing Sheets

ELECTRIC SHOCK PROOF LAMP

FIELD OF THE INVENTION

The invention relates to a lamp, more particularly, to an electric shock proof lamp while being installed.

BACKGROUND OF THE INVENTION

A light-emitting diode (hereinafter "LED") is a semiconductor, which emits light while being electrically connected to an electric power. Due to its technical defects, the LED is employed as an indicator light in an electronic device. Recently, as an LED emitting white light, the LED is adapted for much broader and varied uses, especially for interior lighting.

When compared with a traditional light, an LED has the following advantages:

1. High energy converting efficiency in low light intensity environment. Because the LED has this advantage, the LED is widely used in low intensity back light environment, such as the back light of a mobile phone, or the back light of a television.

2. Rigid structure for better shock withstanding capability. As the LED is solid, the LED has a more rigid structure than a tungsten lamp and a fluorescent lamp for bearing shock.

3. Compact in size. The LED has so low a volume that the LED can be formed into any shape as required. For example, multiple LEDs are arranged to form an array, which provides wider applications on lighting.

4. Long life span. Although the LED is more costly than the traditional light emitting devices, the LED has a longer life span than the traditional light while being used in an environment equipped with good ventilation system.

5. Rapid reaction. The LED has a high flicker frequency.

According to the above advantages, the LED has been widely used in home lighting. In order to substitute our daily light lamp, a fluorescent lamp, for an LED lamp, the LED lamp has a structure similar to the fluorescent lamp. Such an LED lamp has two electrodes mounted on each of two sides of the LED lamp, and formed a circuit with an electric power to convert electric power into light when the two electrodes are connected to a receptacle on two sides of the LED lamp.

However, when such an LED lamp is being installed, the two electrodes are inserted into the receptacle, and other electrodes are disconnected to the receptacle purposefully. Because the electric power is still electrically connected to the LED lamp, a user working on the LED installation may touch the disconnected electrodes and suffers an electric shock.

SUMMARY OF THE INVENTION

An objective of the invention is to provide a light lamp capable of preventing an electric shock while being installed.

To achieve the foregoing objective, a light lamp provided in the invention comprises a light tube, a first holder and a first rotator. The first holder is mounted on a side of the light tube, and comprises a mounting space therein and two through holes in communication with the mounting space. The first rotator is movably received in the mounting space of the first holder between a first position and a second position, and comprises two electrodes extending from the through holes such that when the first rotator is in the first position, the electrodes are electrically connected to the light tube and when the first rotator is in the second position, the electrodes are electrically disconnected to the light tube.

As described above, the first rotator is moved between the first position and the second position, the electrodes are electrically connected to the light tube when the first rotator is in the first position, and the electrodes are electrically disconnected to the light tube when the first rotator is in the second position. In such an arrangement, when the light lamp is installed, a worker firstly follows a process as known in the art to install the light lamp in a receptacle, and next rotates the light tube to allow the first rotator to move from the second position to the first position and be in electric connection to the first holder, and finally a circuit by the light lamp and an electric power are formed. As such, the light lamp in the invention avoids an electric shock while being installed.

DETAILED DESCRIPTION OF THE INVENTION

Other features and advantages of the invention will become apparent in the following detailed description of a preferred embodiment with reference to the accompanying drawings.

Figure 1:
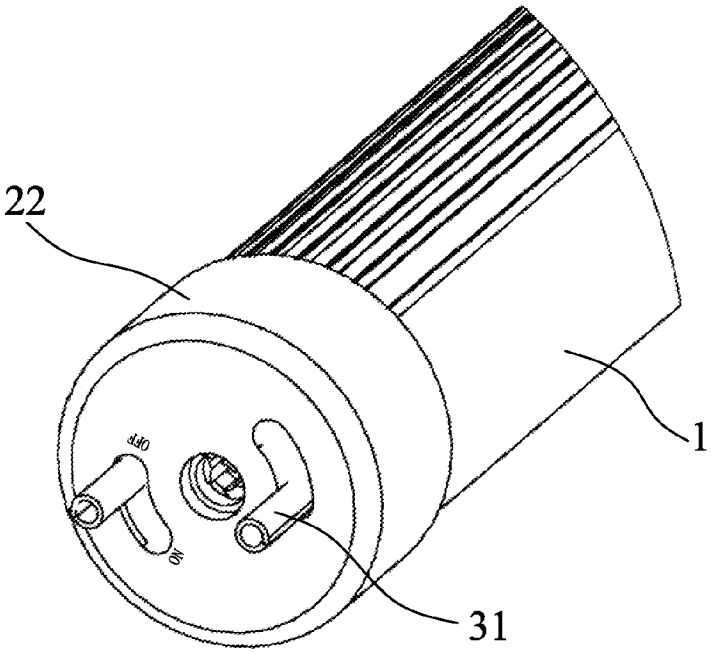
FIG. 1 is a perspective view of a preferred embodiment of a light lamp in the invention.
Figure 2:
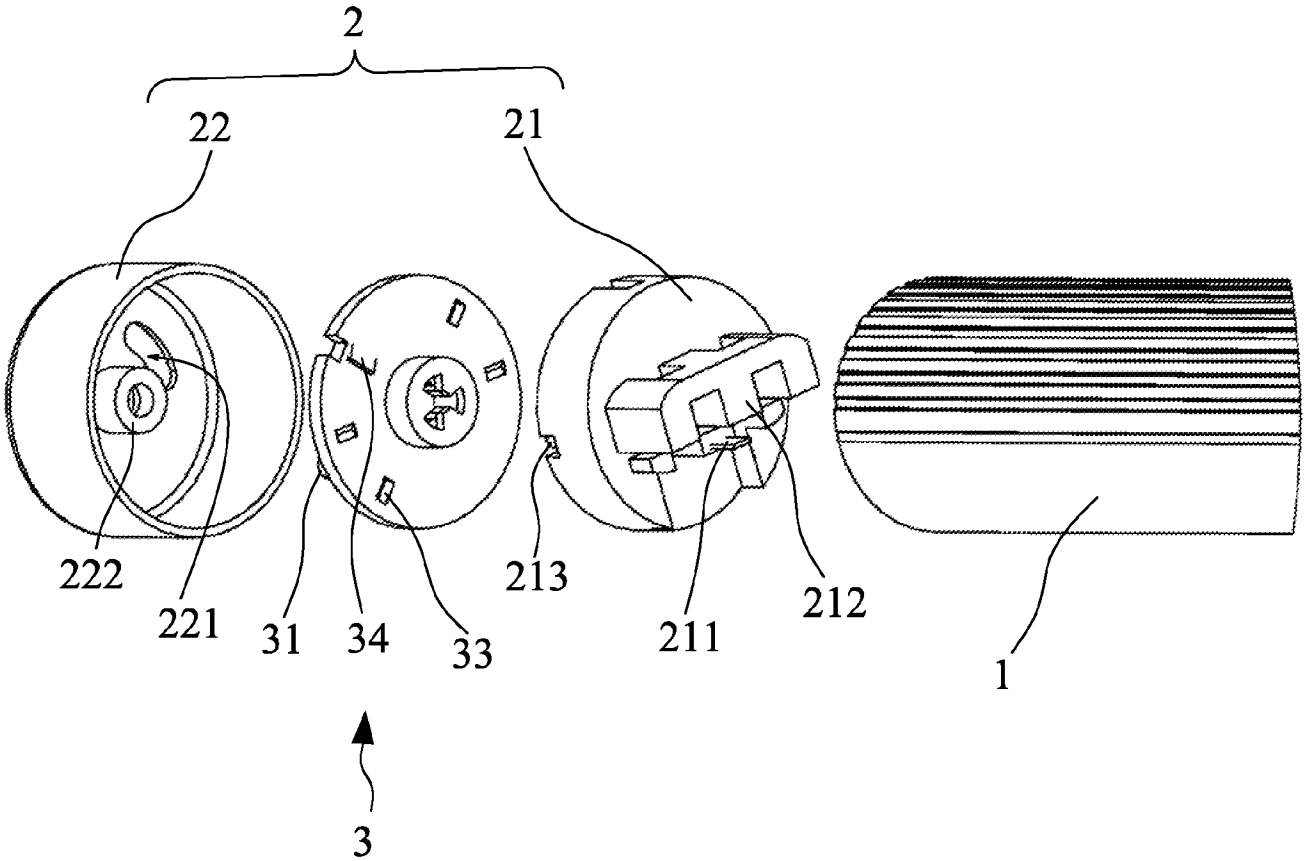
FIG. 2 is an exploded perspective view of the light lamp in FIG. 1.
Figure 3:
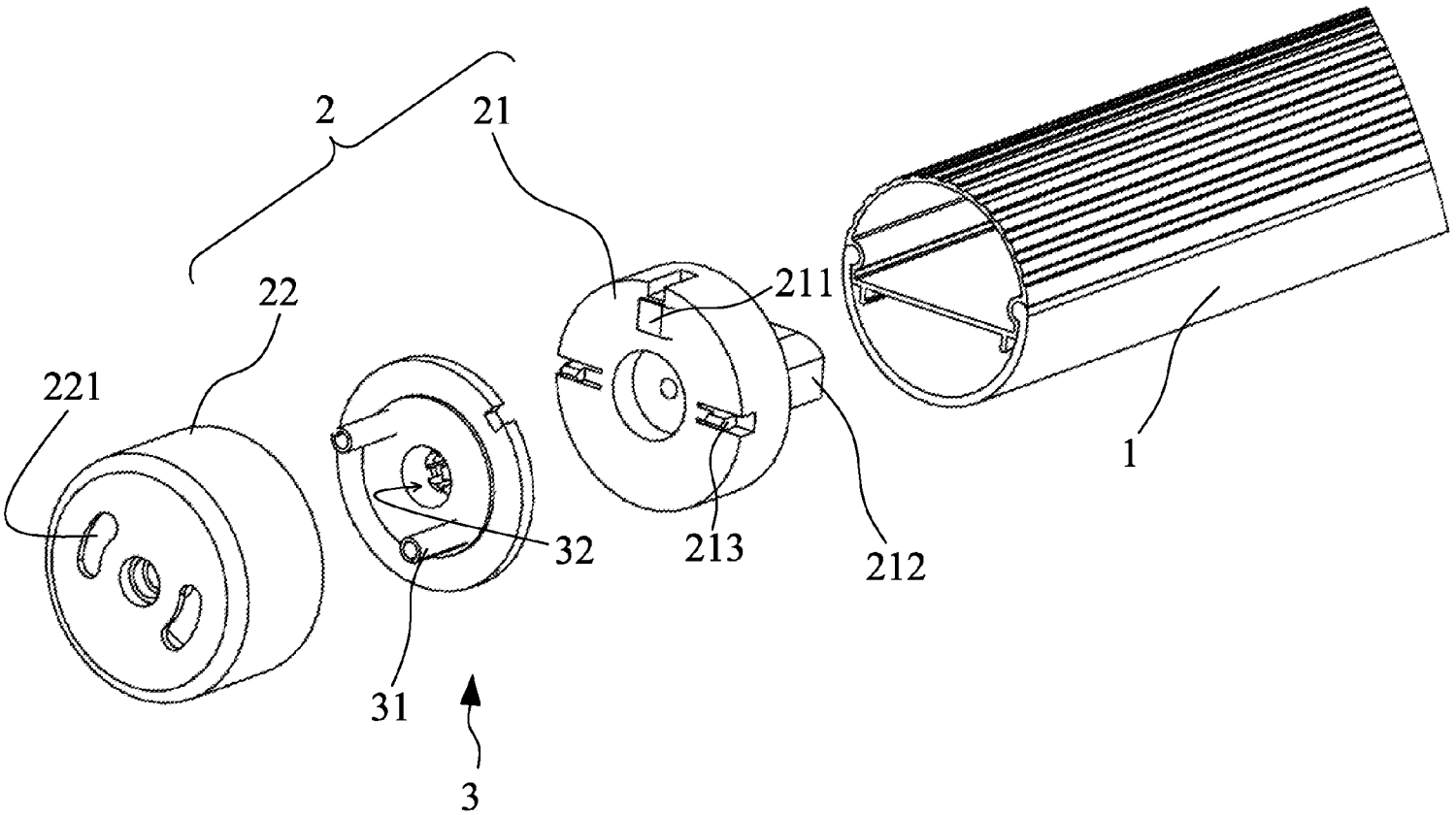
FIG. 3 is another exploded perspective view of the light lamp in FIG. 1.

As shown in FIGS. 1 to 3, a preferred embodiment of a light lamp of the invention comprises a light tube (1), a first holder (2), and a first rotator (3).

The light tube (1) is an LED tube, and the LED tube has an LED positioned inside the LED tube via a way known in the art. For the requirement of lightness, the light tube (1) may have a proper number of LEDs positioned inside the light tube (1). The LED may be positioned in a desired angle inside the light tube (1) for better lighting performance.

The first holder (2) is mounted on a side of the light tube (1), and comprises a mounting space therein. The first holder (2) is a cylindrical casing, and includes a base (21) and a housing (22).

The base (21) is mounted on one side of the light tube (1) and comprises a first conductive connector (211) formed on two opposite surfaces of the base (21), a boss (212) extending in a direction facing to the light tube (1) and at least one first engaging member (213) which is formed on the surface of the base (21). The first conductive connector (211) is electronically connected to the light tube (1). That is to say, the first conductive connector (211) is in good connecting so as to form an electrical connection to the LED in the light tube (1). The boss (212) is adapted to be received in the light tube (1) such that the first holder (2) is securely mounted on one side of the light tube (1). Preferably, the base (21) has two first engaging members (213) securely mounted on the surface of the base (21).

The housing (22) is securely formed with the base (21) such that the mounting space is formed inside the first holder (2). The housing (22) comprises two through holes (221), preferably arcuate in shape, in communication with the mounting space, and a bump (222) positioned on an inner wall of the housing (22).

The first rotator (3) is movably received in the mounting space of the first holder (2) between a first position and a second position and comprises two electrodes (31) extending in and out of the through holes (221), a via hole (32) defined to correspond to the bump (222) of the housing (22), at least one second engaging member (33) formed to correspond to the first engaging member (213), and a second conductive connector (34) formed to correspond to the first conductive connector (211).

When the light lamp is assembled, the second engaging member (33) of the first rotator (3) is movably connected to the first engaging member (213) of the base (21), the base (21) and the housing (22) are securely connected to each other, and the bump (222) of the housing (22) is movably inserted into the via hole (32) of the first rotator (3) such that the first rotator (3) is movably received in the mounting space of the first holder (2).

When the first rotator (3) is in the first position, the electrodes (31) are electrically connected to the light tube (1). When the first rotator (3) is in the second position, the electrodes (31) are electrically disconnected to the light tube (1).

The two electrodes (31) are positioned in the first rotator (3) as electrodes of the fluorescent lamp and electrically connected to a receptacle. The receptacle may be any receptacle for the fluorescent lamp in our daily life. The via hole (32) is adapted to accommodate the bump (222) such that the first rotator (3) is rotated by utilizing an axis formed by the bump (222). The second engaging member (33) is adapted to engage with the first engaging member (213). In the preferred embodiment, the second engaging member (33) is a socket and the first engaging member (213) is an elastic arm so that the second engaging member (33) and the first engaging member (213) are engaged with each other. In another embodiment, the second engaging member (33) is an elastic arm and the first engaging member (213) is a socket, which is still allowable. The second conductive connector (34) is electrically connected to the electrodes (31) and is also a good conductor.

Additionally, the light lamp further comprises a second holder mounted on another side of the light tube (1) and a second rotator mounted inside the second holder. The second holder has a structure the same as that of the first holder (2) and the second rotator has a structure the same as that of the first rotator (3). Specifically speaking, the first holder (2) and the second holder are receptively mounted on the two sides of the light tube (1).

According to the description above, following is to describe the practice of the preferred embodiment of the light lamp in the invention.

Figure 4:
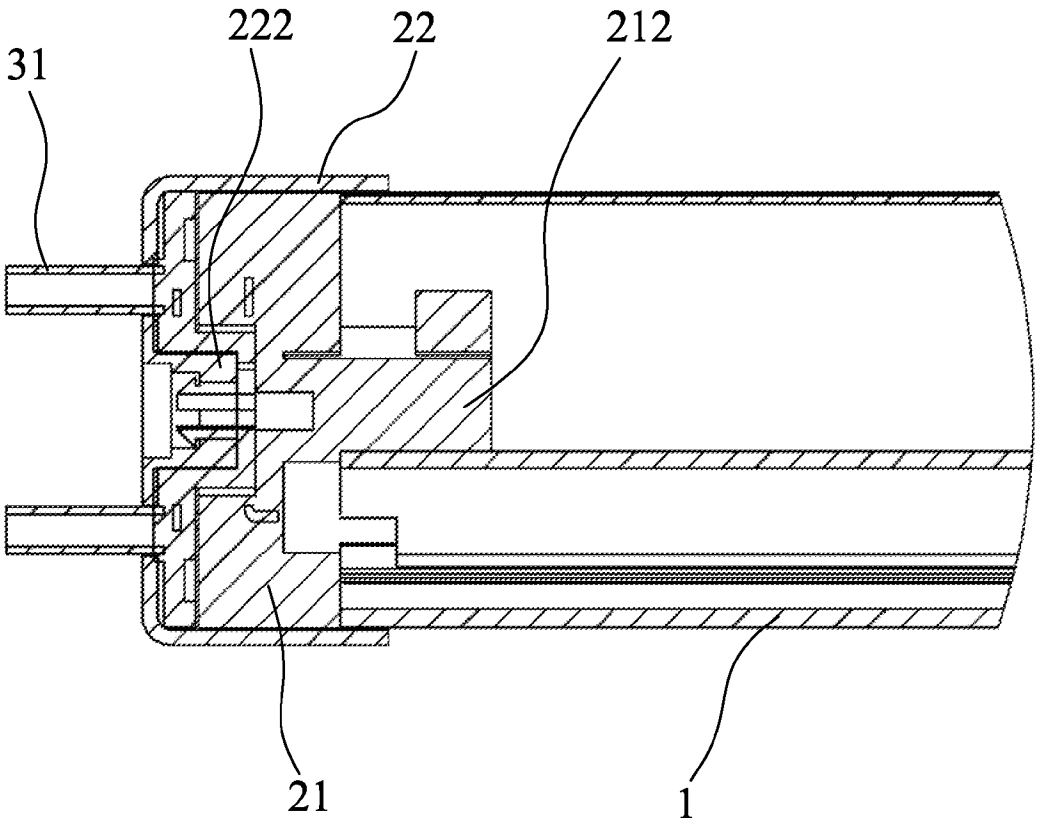
FIG. 4 is a section view of the light lamp in FIG. 1 with a first rotator in a second position.

As shown in FIG. 4, when the first rotator (3) is in the second position ("OFF" as shown in FIG. 1), the first conductive connector (211) of the base (21) is disconnected to the second conductive connector (34) of the first rotator (3). In other words, the electrodes (31) are electrically disconnected to the light tube (1). When the electrodes (31) on one of the two sides of the light tube (1) are inserted into a receptacle by a user and the user accidently touches the electrodes (31) on the other side of light tube (1) when installing the light lamp, the user shall not suffer an electric shock.

Figure 5:
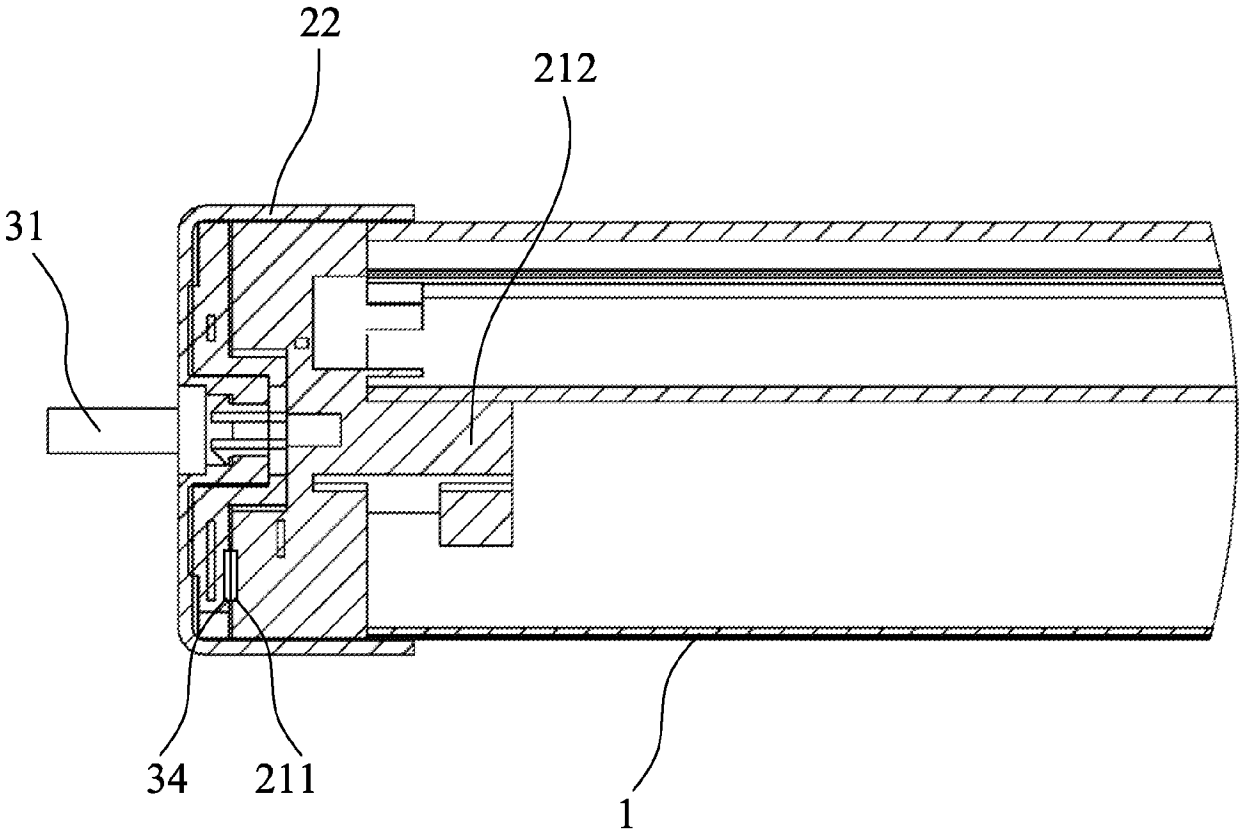
FIG. 5 is a section view of the light lamp in FIG. 1 with a first rotator in a first position.

As shown in FIG. 5, when the first rotator (3) is in the first position ("ON" as shown in FIG. 1), the first conductive connector (211) of the base (21) is connected to the second conductive connector (34) of the first rotator (3). In other words, the electrodes (31) are electrically connected to the light tube (1).

When the light lamp is installed, the user firstly installs the light lamp in the receptacle by a process as known in the art, and next rotates the light tube (1) to rotate the first rotator (3) from the second position to the first position and electrically connected to the first holder (2), and finally a circuit by the light lamp and an electric power are formed.

In the preferred embodiment, the first rotator (3) is rotated 45 degrees from the second position to the first position or vice versa. The first rotator (3) is rotated by any degree more than or less than 45 degrees, which may be allowed. Moreover, the light lamp may have the first holder (2), the first rotator (3), the second holder and the second rotator mounted on the two side of the light tube (1), these rotator shall be in the same position; otherwise, the electrodes (31) on the two sides of the light tube (1) are in an improper position such that the light lamp will not be installed in the receptacle.

The first rotator (3) shall be in the second position before installing the light lamp. In such a way, the light lamp would avoid an electric shock when being installed.

In summary, the light lamp of the invention provides the following advantages:

The light lamp is constructed from simple components, and is able to avoid an electric shock while being installed.

While the invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A lamp, comprising:

a light tube;

a holder mounted on a side of the light tube, and comprising;

a mounting space therein; and two arcuate-shaped through holes in communication with the mounting space; and a rotator received in the mounting space of the holder, rotated around a longitudinal axis of the holder, and comprising:

two electrodes thereon extending from the arcuate-shaped through holes of the holder and electronically connected to an external receptacle, wherein when the rotator is rotated to a first position relative to a first end of the arcuate-shaped through holes, the two electrodes are electrically connected to the light tube;

when the rotator is rotated to a second position relative to a second end of the arcuate-shaped through holes, the two electrodes are electrically disconnected from the light tube.

2. The lamp as claimed in claim 1, wherein the light tube is a light-emitting diode tube.

3. The lamp as claimed in claim 1, wherein the holder comprises:

a base mounted on the side of the light tube, and comprising a first conductive connector formed on a surface of the base for being electrically connected to the light tube; and a housing securely formed with the base to form the mounting space, and having the arcuate-shaped through holes thereon.

4. The lamp as claimed in claim 3, wherein the base further comprises a boss extending in a direction identical with that of the first conductive connector to be received in the light tube.

5. The lamp as claimed in claim 3, wherein the housing further comprises a bump positioned on an inner wall of the housing and the rotator further comprises a via hole defined to accommodate the bump.

6. The lamp as claimed in claim 5, wherein the bump of the housing is movably inserted into the via hole of the rotator.

7. The lamp as claimed in claim 5, wherein the longitudinal axis of the holder passes through the bump of the housing and the via hole of the rotator.

8. The lamp as claimed in claim 3, wherein the base further comprises at least on first engaging member formed on the surface of the base, and the rotator further comprises at least one second engaging member formed to be engaged with the first engaging member.

9. The lamp as claimed in claim 3, wherein the rotator further comprises a second conductive connector formed as being electrically connected to the electrodes, wherein when the rotator is rotated to the first position, the first conductive connector is connected to the second conductive connector so as to electrically connect the electrodes to the light tube; when the rotator is rotated to the second position, the first conductive connector is disconnected to the second conductive connector so as to electrically disconnect the electrodes to the light tube.

10. A lamp, comprising:

a light tube;

a holder mounted on a side of the light tube, and comprising:

a mounting space therein; and two arcuate-shaped through holes in communication with the mounting space; and a rotator received in the mounting space of the holder, rotated around a longitudinal axis of the holder, and comprising:

two electrodes thereon extending out of the mounting space from the arcuate-shaped through holes of the holder and electronically connected to an external receptacle, wherein when the rotator is rotated to a first position relative to a first end of the arcuate-shaped through holes, the electrodes are electrically connected to the light tube;

when the rotator is rotated to a second position relative to a second end of the arcuate-shaped through holes, the electrodes are electrically disconnected from the light tube.

11. The lamp as claimed in claim 10, wherein the light tube is a light-emitting diode tube.

12. The lamp as claimed in claim 10, wherein the holder comprises:

a base mounted on the side of the light tube, and comprising a first conductive connector formed on a surface of the base for being electrically connected to the light tube; and a housing securely formed with the base to form the mounting space, and having the arcuate-shaped through holes thereon.

13. The lamp as claimed in claim 12, wherein the base further comprises a boss extending in a direction identical with that of the first conductive connector to be received in the light tube.

14. The lamp as claimed in claim 12, wherein the housing further comprises a bump positioned on an inner wall of the housing and the rotator further comprises a via hole defined to accommodate the bump.

15. The lamp as claimed in claim 14, wherein the bump of the housing is movably inserted into the via hole of the rotator.

16. The lamp as claimed in claim 14, wherein the longitudinal axis of the holder passes through the bump of the housing and the via hole of the rotator.

17. The lamp as claimed in claim 12, wherein the base further comprises at least on first engaging member formed on the surface of the base, and the rotator further comprises at least one second engaging member formed to be engaged with the first engaging member.

18. The lamp as claimed in claim 12, wherein the rotator further comprises a second conductive connector formed as being electrically connected to the electrodes, wherein when the rotator is rotated to the first position, the first conductive connector is connected to the second conductive connector so as to electrically connect the electrodes to the light tube;

when the rotator is rotated to the second position, the first conductive connector is disconnected to the second conductive connector so as to electrically disconnect the electrodes to the light tube.

* * * * *